United States Patent [19]

Mapes

[11] 4,249,225

[45] Feb. 3, 1981

[54] MAGNETIC FIELD TRANSDUCER SYSTEMS

[75] Inventor: Theodore J. Mapes, Old Saybrook, Conn.

[73] Assignee: The United States of America as represented by the Secretary of the Navy, Washington, D.C.

[21] Appl. No.: 42,824

[22] Filed: May 29, 1979

[51] Int. Cl.[3] ..... H01H 47/32

[52] U.S. Cl. ..... 361/152; 361/203

[58] Field of Search ..... 361/152, 154, 203; 330/10, 11, 137; 318/599

[56] References Cited

U.S. PATENT DOCUMENTS 3,745,420 7/1973 Häfner ..... 361/203 X 3,870,931 3/1975 Myers ..... 318/599 X

*Primary Examiner*—Harry E. Moose, Jr.

*Attorney, Agent, or Firm*—Richard S. Sciascia; Arthur A. McGill; Prithvi C. Lall

[57] ABSTRACT

Means for biasing and driving magnetic field transducers in which the D.C. bias and the information bearing A.C. modulation signal are derived from the same power supply. The drive circuitry, by changing characteristics external to the power supply, enables both the A.C. and D.C. current to flow from a common source through the transducer with the elimination of associated de-coupling networks required for separate A.C. and D.C. supplies.

3 Claims, 6 Drawing Figures

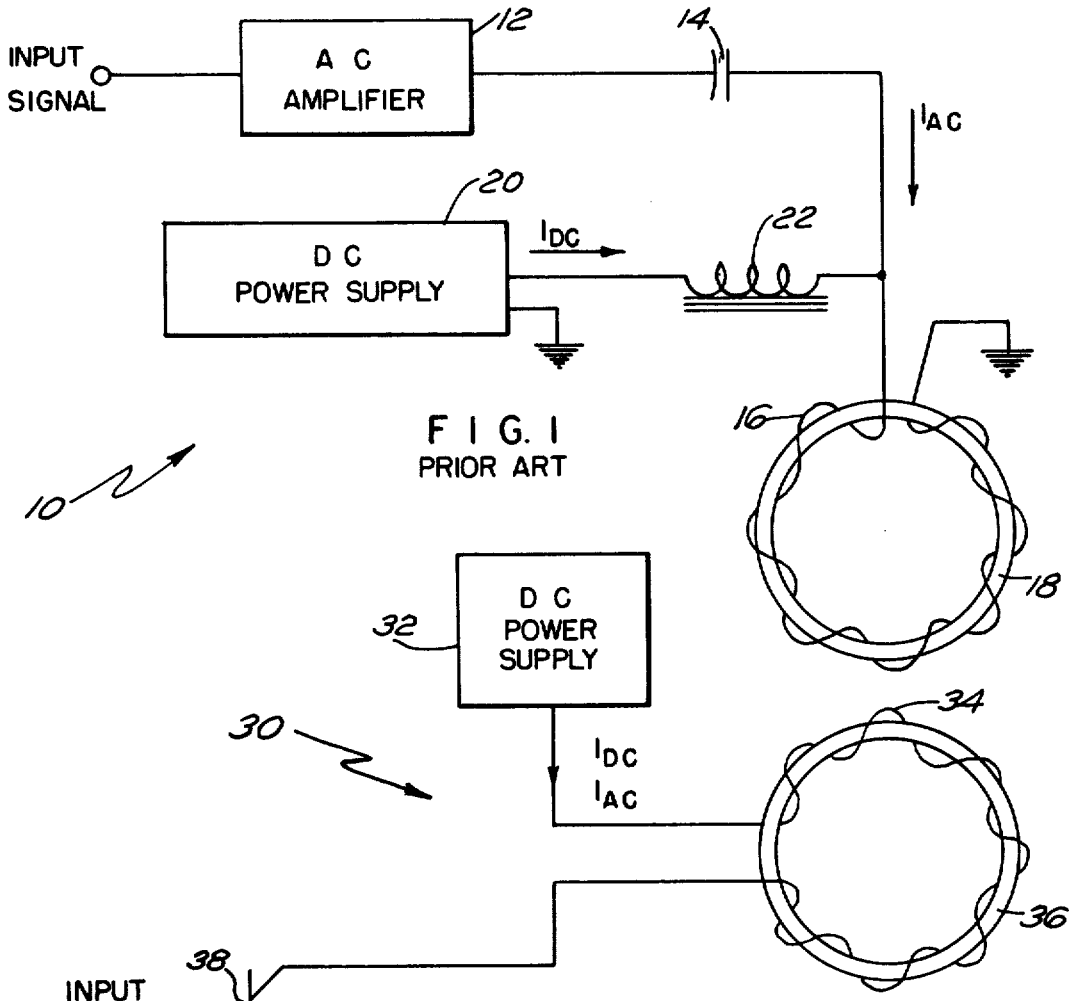
F I G. 1
PRIOR ART
F I G. 2
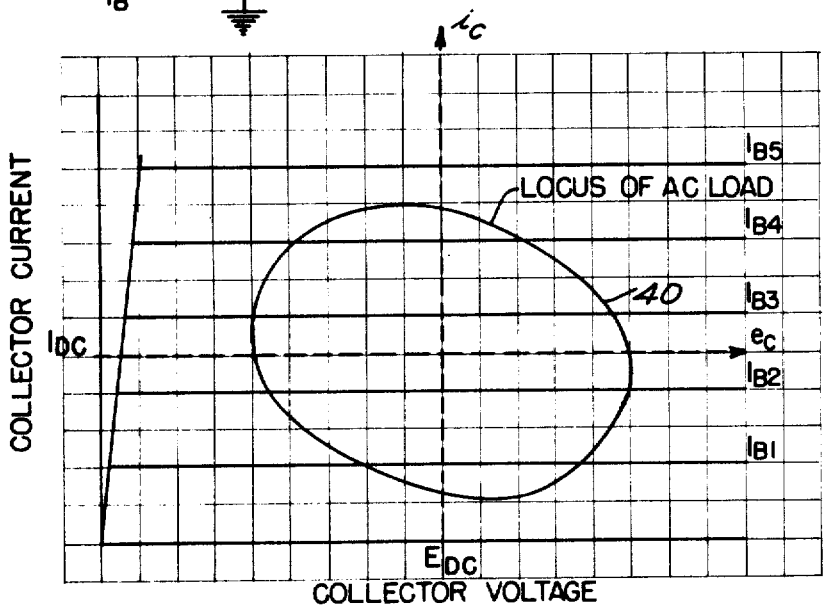
F I G. 3

MAGNETIC FIELD TRANSDUCER SYSTEMS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention generally relates to improved circuitry design on electrical systems having both A.C. and D.C. current. The circuit design is particularly useful for biasing and driving magnetic field transducers.

There are several classes of magnetic field transducers including in particular magnetostrictive and electromagnetic having a variable reluctance. In these types a polarizing magnetic field is required for proper operation of the devices. An alternating magnetic field is superposed on the polarizing field to produce a transducer output, which is then coupled into a mechanical or acoustical load. The alternating field may be continuous wave steady tone, voice modulation, or other time varying signal of interest. The polarizing field may be produced either by a permanent magnet bias in the magnetic circuit or by passing a polarizing direct current through one or more windings placed on the magnetic circuit. This invention relates to the latter method of polarization.

Since both alternating and direct currents pass through the same winding or windings of the transducer, means must be provided to de-couple the polarizing source from the signal source. A conventional prior art system for driving such magnetic field transducers is later described with reference to FIG. 1. A disadvantage of this system is that separate D.C. and A.C. supplies are required. A choke and blocking capacitor are used for de-coupling purposes with a resulting D.C. power loss in the windings of the choke. The above result in an increased size, weight and cost over the present invention. This is particularly true at low frequencies.

SUMMARY OF THE INVENTION

The present invention eliminates the above deficiencies. One embodiment includes a direct drive via one or more transistors, in which the transistor and the transducer share the same bias current, in series. A first alternative embodiment comprises an amplitude modulated carrier, which is demodulated to provide the D.C. bias, with the carrier providing the A.C. signal. A second alternative embodiment utilizes pulse modulation techniques. In the absence of signal, the bias current is provided by unipolar pulses having a repetition rate corresponding to a frequency in excess of the highest signal frequency. Either pulse amplitude or pulse width may be varied to accomplish the desired modulation. This technique takes advantage of the many available semiconductor switch configurations, and will result in the lowest power consumption of the various embodiments proposed.

BRIEF DESCRIPTION OF THE DRAWINGS

FIG. 1 is a representation of a typical prior art conventional drive system;

FIG. 2 is a representation of a drive system in accordance with the present invention;

FIG. 3 shows the $I_c$ vs. $E_c$ characteristics of the locus of operation of the transistor collector of FIG. 2;

DESCRIPTION OF THE PREFERRED EMBODIMENTS

Figure 4:
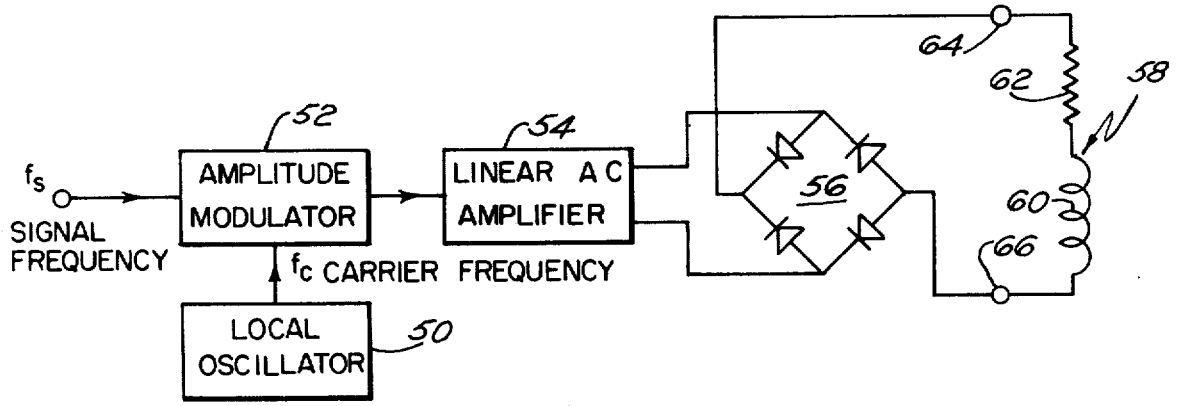
FIG. 4 is a schematic-block diagram of a first alternate embodiment of the invention.

Referring now to FIG. 1 there is shown a prior art conventional drive system 10. In this system 10 a D.C. power supply 20 provides a polarizing current $I_{dc}$ through a choke 22 to the windings 16 of magnetic field transducer 18 where the required polarizing field is established. An input signal, containing the information to be transmitted, is applied to an A.C. amplifier 12. The output of the A.C. amplifier 12, $I_{ac}$, is passed through blocking capacitor 14 to the winding 16 of magnetic field transducer 18 where the required alternating field is superposed on the polarizing field.

The blocking capacitor 14 provides a low impedance to $I_{ac}$ and a high impedance to $I_{dc}$. The choke 22 having a high inductance does the opposite, providing a high impedance to $I_{ac}$ and a low impedance to $I_{dc}$. The choke 22 is required to prevent shunting the alternating signal $I_{ac}$ by the D.C. power supply, which normally will have a very low A.C. impedance to ground.

FIG. 2 shows one of several ways in which the present invention is implemented. It entails drive circuitry that enables the biasing direct current and the information bearing alternating current to flow from a common source through the transducer.

The system 30 has a D.C. power supply 32 connected in series with the windings 34 of magnetic transducer 36 and one or more transistors 38. The system 30 takes advantage of the fact that transistors require a bias current for operation in their linear collector characteristic region. Transistors are inherently high current, low voltage devices. In this configuration of the invention the transistor 38 is operated Class A. The transistor 38 is biased so that its collector current is equal to the correct value of bias current for the windings 34 of transducer 36. The windings 34 on the transducer 36 may be designed to optimize the circuit in terms of the transistor 38 characteristics. If necessary, other components can be added to the system such as coupling capacitors, bias resistors, etc. A theoretical analysis of the circuit depicted in FIG. 2 facilitates optimization of the design. The electrical impedance of the transducer is modeled by a series resistance-inductance circuit, in which the values of R and L vary with frequency. As shown in FIG. 3 this circuit leads to an elliptical locus 40 of operation on the transistor collector, $I_c$ vs. $E_c$ characteristics. The size and eccentricity of the ellipse 40 vary with frequency as well as with the values of R and L. The elliptical A.C. load characteristics are superposed on a set of transistor 38 collector characteristics. Operation is entirely within the linear range of the transistor 38. If necessary, two or more transistors may be used in parallel to obtain the required value of the windings 34 bias current. The transistor 38 is biased into the correct range of operation by application of a D.C. base current $I_B$. The A.C. modulation is applied to the base of the transistor 38, causing the collector current to vary along the elliptical locus of FIG. 3, thus producing the desired alternating current in the transducer windings 34.

A Class A design approach requires the transistor components to dissipate a considerable amount of power. This leads to requirements for cooling the transistors. Several alternate approaches obviate this requirement.

Referring now to FIG. 4 there is shown a system that applies the principles of amplitude modulation. A carrier frequency $f_c$ is generated in a local oscillator 50. This is mixed with the signal frequency $f_s$ in an amplitude modulator 52 and provides an amplitude modulated signal that drives a linear A.C. amplifier 54. The output of the amplifier 54 is demodulated in a full-wave bridge rectifier 56. The output of the bridge rectifier 56 is connected to the transducer windings 58 which are shown as an inductance 60 and resistance 62 connected in series across terminals 64 and 66.

In order to operate the system of FIG. 4, the signal $f_s$ is disconnected and the amplitude of the carrier signal $f_c$ is adjusted so that the average value of the rectified output current from the bride 56 is equal to the required D.C. bias current in the transducer 58. The inherent inductance 60 of the transducer 58 acts as a smoothing filter for harmonics of the rectified carrier signal.

When a modulating signal of a frequency $f_s$, which is considerably lower than the carrier frequency $f_c$, is applied, an amplitude modulated waveform is produced at the output of modulator 52 and linear amplifier 54. The bridge rectifier 56 produces a current in the transducer 58 which varies above and below the bias current established with no modulation present at the signal frequency $f_s$.

Figure 5:
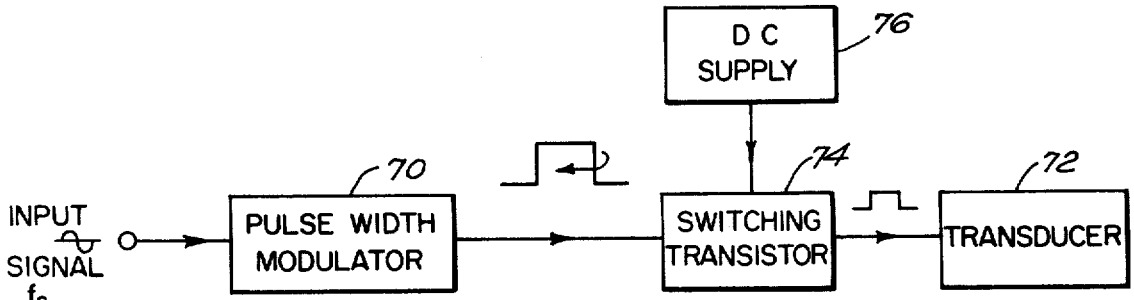
FIG. 5 shows a block diagram of a second alternate embodiment of the invention.

Referring now to FIG. 5 there is shown a pulse width modulator that in the absence of an input signal supplies a square wave signal having a 50% duty cycle and an amplitude that is twice the required bias signal for the transducer 72. On applying the information A.C. input signal $f_s$ the length of the output pulse of modulator 70 is varied. This signal is then applied to the switching transistor 74 which conducts a current from D.C. supply to transducer 72.

Figure 6:
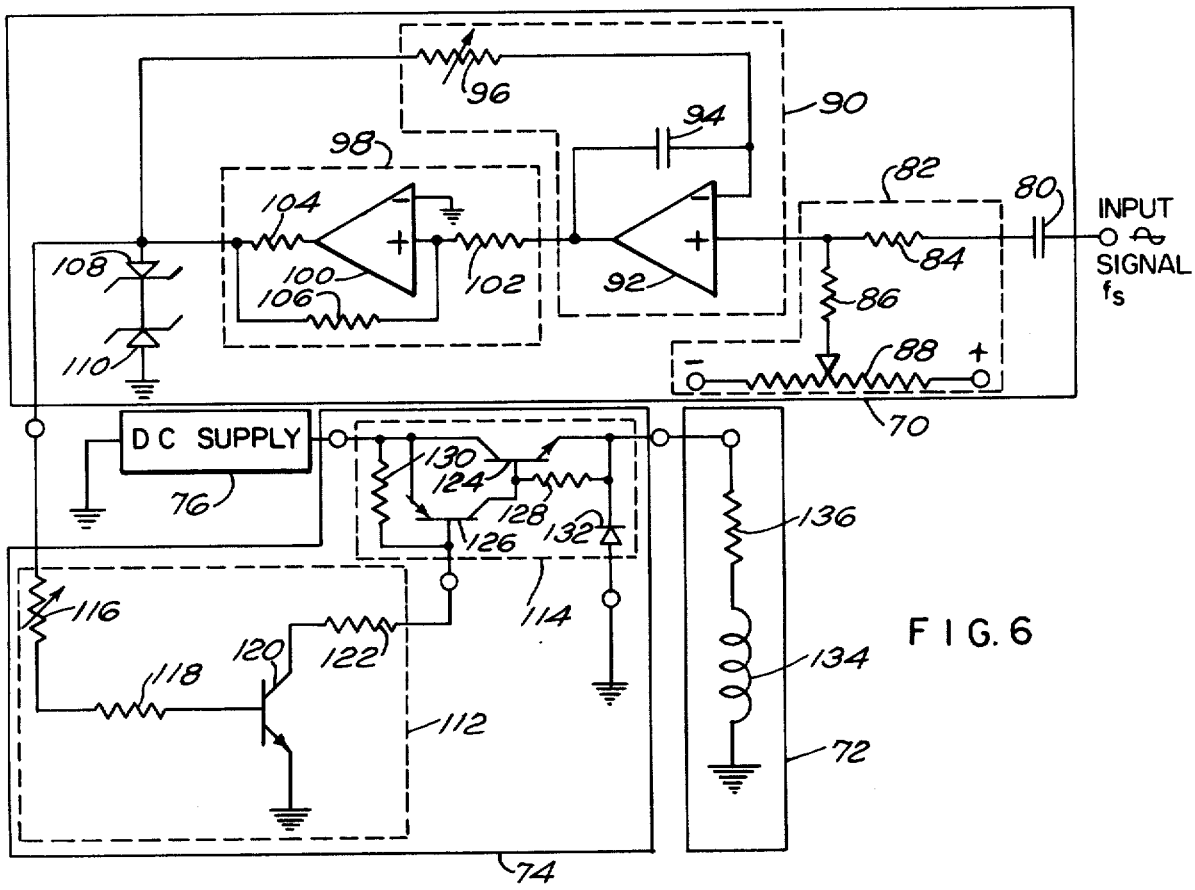
FIG. 6 shows a schematic illustration of the embodiment of FIG. 5.

FIG. 6 is a schematic diagram of FIG. 5. The modulation signal $f_s$ is applied to the input of the pulse width modulator 70. The signal $f_s$ is applied through coupling capacitor 80 to summing network 82 comprised of resistors 84 and 86. The potentiometer 88 is adjusted so as to produce a symmetrical square wave at the output of the pulse width modulator 70 in the absence of a modulating signal. A triangle generator 90 is connected to the output of summing network 82. The triangle generator comprises an operational amplifier 92, capacitor 94 and variable resistor 96. In the absence of an input signal to modulator 70, variable resistor 96 is adjusted for the switching frequency, which is controlled by variable resistor 96 and capacitor 94. The triangle generator 90 is connected to comparator 98. The comparator 98 is comprised of operational amplifier 100, resistors 102, 104 and 106, and zener diodes 108 and 110. When modulation is applied to pulse width modulator 70, the symmetry of the triangle generator 90 is altered in accordance with the amplitude and polarity of the modulation signal. This causes the width of the output pulses of modulator 70 to vary.

The output of the pulse width modulator 70 is applied to the switch 74, which is placed between the D.C. supply 76 and the transducer 72. The switch 70 comprises a driver transistor network 112 and a high speed switching regulator 114 of the type used in switching power supplies. The driver transistor network 112 is comprised of a variable resistor amplitude control 116, resistor 118, transistor 120 and resistor 122. The high speed switching regulator 114 is comprised of transistors 124 and 126, resistors 128 and 130, and diode 132. The switching regulator 114 is connected to transducer 72, whose windings are shown as being comprised of an inductor 134 and a resistor 136.

In operation the switch 74 acts in concert with the pulse modulator 70 connecting the D.C. supply 76 to the transducer 72 for positive pulses and disconnecting the D.C. supply 76 on negative pulses. Thus a pulse width modulated current is produced in the windings of transducer 72. The amplitude control 116 regulates the drive into the switch. The D.C. supply voltage 76 is adjusted such that no width modulation applied, the proper bias current is furnished to the transducer 72. Application of modulation causes the transducer 72 current to vary around the bias value, producing acoustical output from the transducer 72, in the medium, due to magnetostrictive effect.

There has, therefore, been described a plurality of systems for driving magnetic field transducers. These systems result in the elimination of separate A.C. and D.C. power supplies, and large expensive inductors and capacitors that are used as de-coupling components by the prior art.

It will be understood that various changes in details, materials, steps and arrangement of parts, which have been herein described and illustrated in order to explain the nature of the invention, may be made by those skilled in the art within the principle and scope of the invention as expressed in the appended claims.

What is claimed is:

1. A magnetic field transducer system comprising:

a local oscillator for providing a carrier frequency signal;

amplitude modulation means connected to said local oscillator to receive the carrier frequency signal and adapted to receive a control signal, said amplitude modulation means providing an amplitude modulated signal;

a demodulator connected to said amplitude modulation means for receiving the amplitude modulated signal, said demodulator providing a demodulated signal at a predetermined D.C. bias level; and a transducer connected to said demodulator for receiving the demodulated signal at the predetermined D.C. bias level.

2. A magnetic field transducer system according to claim 1 wherein said amplitude modulation means further comprises an amplitude modulator and a linear amplifier.

3. A magnetic field transducer system according to claim 2 wherein said demodulator further comprises a four diode bridge circuit.

* * * * *